US005180438A

United States Patent [19]

Hockh et al.

[11] Patent Number: 5,180,438

[45] Date of Patent: Jan. 19, 1993

[54] CLEANING AND DRYING SYSTEM

[75] Inventors: Jurgen Hockh, Neuenburg; Franz Koppelhuber, Otisheim, both of Fed. Rep. of Germany

[73] Assignee: Hockh Metall-Reinigungsanlagen GmbH, Neuenburg, Fed. Rep. of Germany

[21] Appl. No.: 709,831

[22] Filed: Jun. 4, 1991

Related U.S. Application Data

[63] Continuation-in-part of Ser. No. 419,949, Oct. 11, 1989, abandoned.

[30] Foreign Application Priority Data

Sep. 19, 1990 [DE] Fed. Rep. of Germany ... 9013241[U]

[51] Int. Cl.[5] ..... B08B 3/00; B08B 5/04

[52] U.S. Cl. ..... 134/21; 134/10; 134/12; 134/18

[58] Field of Search ..... 134/10, 12, 18, 21

[56] References Cited

U.S. PATENT DOCUMENTS 3,610,260 10/1971 Kearney ..... 134/12
4,101,340 7/1978 Rand ..... 134/12
4,424,633 1/1984 Bernhardt et al. ..... 134/40
5,045,117 9/1991 Witherell ..... 134/25.4

FOREIGN PATENT DOCUMENTS 2406347 8/1975 Fed. Rep. of Germany .
3715168 12/1988 Fed. Rep. of Germany .
2422915 4/1979 France .

*Primary Examiner*—Theodore Morris
*Assistant Examiner*—Zeinab El-Arini
*Attorney, Agent, or Firm*—Spensley Horn Jubas & Lubitz

[57] ABSTRACT

The system comprises a cleaning fluid circuit including at least one sealable cleaning vessel, which is adapted to hold a vacuum and contains a carrier for carrying stock to be cleaned and dried. The cleaning vessel is adapted to be hermetically sealed from the atmosphere and from the cleaning fluid circuit is adapted to be directly connected to the suction port of an ejector so that each batch of stock can be cleaned and can subsequently be dried more quicly and to a higher degree by the application of a desired vacuum. Even if the cleaning fluid consists of an organic solvent, the pollution of the premises and of the environment by solvent vapors will be minimized.

10 Claims, 1 Drawing Sheet

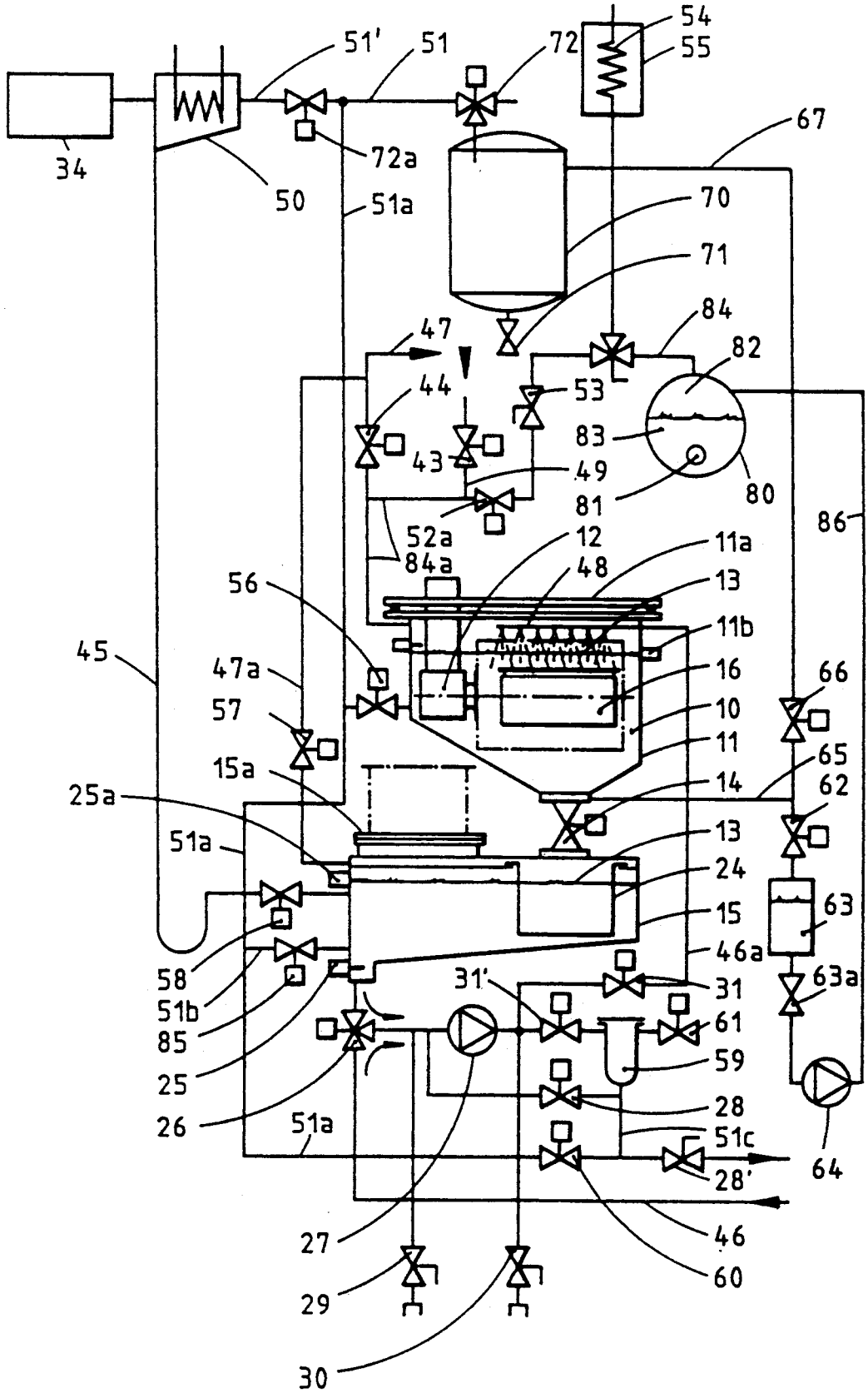
34
50
51'
51
72
72a
54
55
67
51a
70
71
47
84
82
44
53
83
43
49
80
81
86
52a
84a
12
48
11a
13
56
11b
45
47a
16
66
57
10
11
65
15a
14
62
25a
13
51a
24
63
15
46a
58
31'
31
63a
51b
61
85
59
25
28
26
51a
51c
64
28'
27
46
29
60
30

CLEANING AND DRYING SYSTEM

CROSS REFERENCE TO RELATED APPLICATION

This is a continuation-in-part of application Ser. No. 07/419,949, filed Oct. 11, 1989, and abandoned as of the filing date of the present application.

BACKGROUND OF THE INVENTION

1. Field of the Invention

This invention relates to a cleaning and drying system, particularly to such a system which comprises an apparatus for drying discrete objects, such as workpieces which have been mechanically shaped, e.g., by turning or stamping, and have been cleaned in a washing or degreasing system which includes a cleaning fluid circuit that comprises a cleaning fluid reservoir and a cleaning vessel, which contains a stock carrier for the objects to be cleaned, which system also includes a vacuum pump which serves to suck off cleaning fluid vapors and which is adapted to be supplied with entraining fluid consisting of the cleaning fluid from an entraining fluid reservoir by a circulating pump.

2. Description of the Prior Art

Such a system is known from U.S. Pat. No. 3,610,260. In that known system the cleaning chamber is sealed only to prevent an escape of solvent vapors. The objects which have been transported out of the cleaning chamber are dried by means of a heater in a separate drying chamber. The vapors formed by the drying operation are sucked off under a low vacuum by means of a pump so that the solvent which has been evaporated by means of the heater can be recovered. A satisfactory drying cannot be effected without a heater and additional energy is required for the heating. Besides, the drying chamber is so designed that it cannot be used to dry under a substantial vacuum.

Another known system of that kind is known from U.S. Pat. No. 4,424,633 and comprises a chamber, which is in open communication with an evaporator for the liquid and in which the objects are cleaned by solvent vapors coming from the evaporator for the solvent. The heat of condensation which is thus recovered is used to dry the objects. The contaminated solvents are drained in a liquid state. That part of the solvent which is in a gaseous state is sucked off. The vacuum pump used to suck off that gas cannot generate high vacuums for drying because the cleaning chamber cannot be sufficiently tightly sealed and cannot be disconnected from the remaining system. Besides, the vacuum pump will freely deliver the finally sucked-off vapors into the atmosphere.

In a comparable system which is known from Published German Application 33 19 094 a mechanical pump or an ejector is used to suck solvent vapors from an antechamber, which precedes the cleaning chamber. But that device is not used for drying but only to reduce the amount of vapors which escape into the atmosphere and to recover such vapors.

It is also known to use for drying any desired vacuum pump, such as a liquid ring pump (see, e.g., the German periodical vt., "Verfahrenstechnik" 15 (1981) No. 2, pages 116, 117.

SUMMARY OF THE INVENTION

In view of the prior art discussed hereinbefore it is an object of the invention to provide a method and system which is of the kind described first hereinbefore and in which the objects are cleaned in batches and can be dried quickly and intensely with the aid of a vacuum. When aqueous cleaning fluids are used a drying to a high degree is to be effected in a short time.

A further object of the invention is to provide a method in which objects which are generally considered to be difficult to dry can be cleaned by means of water, to which detergents may be added, and can yet be thoroughly dried in a reasonable period of time.

The above and other objects according to the invention are achieved by a process for washing and drying stock consisting of discrete objects in a system composed of an aqueous washing fluid circuit including a washing fluid reservoir for holding an aqueous washing fluid constituted by hot water and at least one washing vessel connected to receive the washing fluid from the reservoir; a stock carrier contained in the washing vessel to support the stock; an underpressure container; a vacuum pump; and connection means including conduits and valve means connected for controlling communication among the pump, the underpressure container and the washing vessel, the process comprising:

a washing phase for washing the stock including:

supporting stock in the stock carrier in the washing vessel;

operating the washing fluid circuit to bring washing fluid into contact with stock in the washing vessel and maintaining the washing fluid in contact with the stock for a sufficient time to heat the stock and to effect cleaning of the stock; and a phase including:

connecting the underpressure container to the pump whereby the washing vessel is isolated from the pump and from the underpressure container, and operating the pump to place the underpressure container under a vacuum pressure substantially below atmospheric; and a drying phase beginning at a time when the cleaning fluid is drained from the cleaning chamber, the temperature of the stock is substantially above room temperature due to contact with the washing fluid, the pressure in the washing vessel is substantially atmospheric, and the underpressure container is at the vacuum pressure; and including: abruptly placing the valve means in a first state in which the underpressure container is connected to the washing vessel for producing an abrupt pressure drop in the washing vessel and across the entirety of the surfaces of the stock and to achieve pressure equalization between the washing vessel and the underpressure container after said step of placing the valve means in a first state placing the valve means in a second state to connect the vacuum pump with the cleaning vessel and to isolate the vacuum container from the cleaning vessel and operating the pump until the end of the drying phase to increase continuously the underpressure in the cleaning vessel, produced by the pressure equalisation between the washing vessel and the underpressure container, approximately up to the maximum underpressure attainable by the vacuum pump.

A collecting vessel and the filter of the washing fluid circuit are subjected to the vacuum when the cleaning fluid has been drained and before the contents of the collecting vessel or of the filter in the filter housing have been removed. The application of the vacuum will result in an intense drying of the contents of the collecting vessel and the filter.

The drying can greatly be intensified by a supply of atmospheric air while the vacuum is maintained if that part of the system which is subjected to the vacuum is adapted to be supplied with air through a valve during the application of a vacuum by the vacuum pump. The relative humidity of the air which is supplied will be below the saturation limit, as a rule, so that the air has a higher absorption capacity in the cleaning chamber and a drying to an adequate degree can be effected within a relatively short time. This will be particularly desirable if the objects to be dried have interior spaces which are difficultly accessible.

Each part which is subjected to a vacuum may be adapted to be supplied with air through a valve and a throttle valve during the drying and the air which is to be supplied may be adapted to be heated by means of a heat source through a heat exchanger before said air is supplied so that the vapor concentration in the cleaning basket after the drying can be further reduced.

BRIEF DESCRIPTION OF THE DRAWING

The single FIGURE of the drawing is a diagrammatic representation of the system embodying the invention.

DETAILED DESCRIPTION OF THE PREFERRED EMBODIMENT

The invention will now be explained more in detail with reference to an embodiment shown by way of example.

The objects to be cleaned and dried may consist of workpieces which have been mechanically shaped, e.g., by turning or stamping, and will be described hereinafter as "stock". The aqueous washing cleaning fluid circuit of the cleaning system includes a washing fluid reservoir, not shown, and a washing vessel 11. As a rule, that circuit also includes a filter, particularly a fines filter, for retaining solid particles, and in many cases includes also a distillation plant for a regeneration of the cleaning fluid. The cleaning fluid circuit is operated by means of a pump 27 and is adapted to be controlled by means of the three-way valve 26 and the valves 31 and 31', which are included in the circuit on the upstream and downstream sides, respectively, of the pump 27. The cleaning vessel 11 includes a cleaning chamber 10 and is adapted to be sealed by means of a cover 11*a* and adapted to hold a vacuum in the cleaning chamber 10. The cleaning chamber 10 contains a spray tube 48, which has orifices disposed over a stock basket 16, which contains the stock and is adapted to be agitated by a rotating or rocking drive 12. The stock basket 16, the cover 11 and the rotating or rocking drive 12 constitute a unit of construction, which is adapted to be lifted from and to be placed onto the cleaning vessel 11, which defines the cleaning chamber 10. The cleaning vessel 11 is connected by a shut-off valve 14 to a collecting vessel 15, which is also adapted to hold a vacuum. In the collecting vessel 15 a sieve basket insert 24 is so arranged that the cleaning fluid which drains from the cleaning chamber 10 into the collecting vessel 15 enters the sieve basket insert 24 from above so that a major part of the solid dirt particles entrained by said fluid will be retained by said insert 24. Liquid level detectors 25, 25*a* are contained in the collecting vessel 15 and are used to prevent an overfilling and an unintended emptying of the collecting vessel. The shut-off valves 28, which are included in the circuit adjacent to the pump 27, are closed for maintenance. Branch lines lead from the circuit through respective shut-off valves 29 and 30 to a cleaning fluid reservoir and permit the cleaning fluid circuit to be emptied and refilled. The cleaning chamber 10 is adapted to be connected by a vent line 47, 84*a* to the cleaning fluid reservoir of the cleaning fluid circuit and through an air supply line 49 to the atmosphere. An overpressure container 80 contains heater means 81, a body of water 83 for generating superheated water vapor and a reservoir chamber 82. Superheated water vapor collected in chamber 82, or air heated in a heat source 54 in a chamber 55, can be supplied to cleaning chamber 10 via a line 84 and line 84*a*, controlled by a controllable valve 52*a* and a throttle valve 53. Line 84 can be given a pre-selected flow-through cross section by adjustment of throttle valve 53. A branch line 47*a* connects the vent line 47 to the collecting vessel 15 via a valve 57. The sieve basket insert 24 provided in the collecting vessel 15 is horizontally shiftable (to the left in the drawing) and is vertically movable out of the collecting vessel through its open top, which can be sealed by means of a cover 15*a*.

The embodiment shown by way of example includes a vacuum pump 34. The sealable cleaning chamber 10 is connected to the suction port of pump 34 by a suction 51*a*, 51', which is provided with a shut-off valve 56. The vacuum produced by pump 34 may also be applied to a filter, which is accommodated in a filter housing 59, by opening valves 72*a* and 60.

An underpressure container 70 is connected with the cleaning chamber 10 via a line 51, 51*a*, which can be opened and closed by valve means 72, 56. With the line 51*a* closed, the underpressure container 70 is evacuated by means of vacuum pump 34 via a line 51', 51 and a condenser 50 with valve 72 open until exhaustion of the capacity of the vacuum pump 34, long enough so that an appropriate vacuum has been generated in the underpressure container 70. Condenser 50 is an indirect heat exchanger having an aqueous condensate collecting region which communicates with a drain line 45 that leads to valve 58. When valve 58 is open, aqueous condensate is conducted to collecting vessel 15.

At a time when the stock, because of the previous washing process, has a temperature which lies considerably above room temperature and at which no underpressure or no appreciable underpressure has yet been generated by the vacuum pump 34 in cleaning chamber 10, the line 51, 51*a* between the underpressure container 70 and the cleaning chamber 10 is completely opened in an abrupt manner and, because of this, an instantaneous pressure equalization is produced between the underpressure container 70 and the cleaning chamber 10. The pressure equalization causes an abrupt sudden pressure drop in the cleaning chamber 10 across the entirety of the surfaces of the stock, which pressure drop will be referred to as "vacuum shock" hereinafter.

The line 51, 51*a* may be opened to generate the vacuum shock when the stock is still at a temperature, from the previous washing process, which lies only slightly below the temperature of the wash water, and when the vacuum pump 34 just starts, via the line 51' as well as a section of line 51*a* and the open valve 56, to build up the vacuum in the cleaning chamber 10 for drying the stock.

Steam, which is at a temperature of between 110° and 150° C., is generated in overpressure container 80 with the line 84, 84*a* closed. Immediately following the completion of an occurrence of vacuum shock, the line 84, 84*a* is opened sufficiently far so that a gradual pressure equalization takes place between overpressure container 80 and cleaning chamber 10, which pressure equalization may last between 10 and 500 seconds. During this period of time, superheated water vapor flows into cleaning chamber 10 and as a result heat energy is applied to the surface of the stock.

For the purpose of introducing the superheated water vapor into cleaning chamber 10, the line 84, 84*a* is opened at a time at which the underpressure, generated by the vacuum shock, in cleaning chamber 10 is at least still 60% of the maximum underpressure which can be generated by means of the vacuum shock. This value is relative to a value of 100% which corresponds to the maximum underpressure value and a value of 0% which corresponds to atmospheric pressure.

Prior to the start of the washing process and completion of the vacuum shock, greatly solid stock, in particular that contaminated with fatty residue, is "degreased" in that superheated water vapor is introduced into cleaning chamber 10 for this purpose as described above. The water vapor condenses on the stock, because of which the stock is rinsed with hot condensing water for degreasing. After pre-degreasing, the dirty water is introduced via the line 65, 67, controlled by a valve 66, into the underpressure container 70 and distilled there. The valve 71 at the bottom of underpressure container 70 permits the removal of fatty sludge generated during the distillation of the dirty water. At the completion of the washing process and prior to the start of the vacuum shock, the stock, which still contains residue after the washing process, is again cleaned in that superheated water vapor is introduced from container 80 into cleaning chamber 10. The water vapor condenses on the stock so that the stock is rinsed with hot condensing water. After rinsing, the condensing water is collected via a line 65 as well as the valve 62 in a reservoir 63 and can be transferred periodically by means of a pump 64 and via the valve 63*a* and the line 86 into the overpressure container 80 for the generation of steam.

The system operates as follows.

The cleaning system is operated in different modes in alternation. In one of said modes the stock which has been introduced in the stock basket 16 into the cleaning chamber 10 is cleaned, i.e., washed or degreased, in the cleaning chamber 10. In the second mode the cleaned stock is dried. During the operation in the washing mode the washing fluid is supplied from the aqueous washing fluid reservoir through line 46, the open three-way valve 26, the circulating pump 27 and the open shut-off valve 31 in line 46*a* to the spray tube 48 in the cleaning chamber 10 to flow over the stock contained in the stock basket 16. As a result, the sealed cleaning chamber 10 is gradually filled with the cleaning fluid so that the liquid level in the cleaning vessel 11 rises above the stock contained in the stock basket 16. The cleaning process is assisted by the rotary or rocking motion which is imparted to the stock basket by the rotating or rocking drive 12. As soon as the liquid level in the cleaning chamber 10 has reached the liquid level detector 11*b*, the supply of cleaning fluid is discontinued. The washing aqueous fluid with which the stock is washed is hot water, for example at 85° C., to which the detergents may have been added. During the flooding of the cleaning chamber in the manner described, the vent valve 44 is open so that air is displaced out of the cleaning chamber 10 through the vent line 47.

When the operation in the cleaning mode has been terminated, the shut-off valve 14 is opened so that the cleaning fluid 13 is drained from the cleaning chamber 10 into the collecting vessel 15 and pump 27 can be operated to move the cleaning fluid 13 from the collecting vessel 15 through the three-way valve 26, the pump 27 and valve 30 to a line leading to the cleaning fluid reservoir. Operation in the drying mode involves the following:

During the cleaning or after cleaning and before drying underpressure container 70 with a volume of approximately 0.8 $m^3$ is evacuated by means of a vacuum pump 34 via the line 51', 51, until a vacuum with the maximally attainable underpressure of approximately 950 mbar has been generated. As described herein, the stock is washed in cleaning chamber 10 which has a volume of approximately 0.3 $m^3$. This is done by means of hot water containing detergents and having a temperature of approximately 85° C. In the course of the washing process the temperature of the stock rises to almost the same temperature as the hot water. Immediately following the washing process, i.e. at a time when the stock still has almost the temperature of the wash water, an opening connection between the underpressure container 70 and the cleaning chamber 10 is established via the line 51, 51*a* by abrupt opening of at least one of the valves 72, 56. Because of this, an abrupt underpressure, or vacuum shock, of approximately 650 mbar is created in cleaning chamber 10. The generation of this underpressure is equivalent to a considerable lowering of the boiling point of the water adhering to the stock.

The lowering of the boiling point while the stock still has a relatively high temperature, close to the temperature of the wash water at 85° C., causes the steaming off of water films from the surface of the stock. If there are still water droplets in or on the stock, for example in interior hollow spaces of the stock, these droplets are pulled out of the interior hollow spaces by the vacuum shock. Vacuum pump 34 is already running when the vacuum shock is generated, so that the water vapor and condensed water droplets generated during the steaming off of the water film, as well as floating water droplets, are sucked off. A condenser device 50 assures shielding of the vacuum pump 34 from steam and water during this suction. The underpressure in the cleaning chamber 10 is continuously increased by the vacuum pump 34 up to the maximum underpressure of approximately 950 mbar attainable by this pump. The drying process can be completed relatively quickly under these underpressure conditions. The vacuum pump 34 is running until the end of the drying phase.

Extensive tests have shown that a reduction in the time of the drying process of 50 to 300% can be achieved by the use of the vacuum shock in accordance with the invention. The degree of speeding up of the drying process which is achievable depends essentially on the mass of the stock and on the structure and size of the individual pieces of material to be cleaned. The greatest positive effect of the vacuum shock is achieved with stock having a relatively large mass of material to be cleaned, which consists of relatively large objects of complex geometry having hollow spaces or blind bores.

It was found in the course of further testing that in connection with stock which is extremely hard to dry, for example small, curved metal tubes of 3 mm diameter and 20 mm length, a further considerable speed-up of the drying process could be achieved by applying heat to the stock by introducing a heated gaseous medium into the cleaning chamber 10. It was found that overheated vapor is most effective as carrier for heat. But also air may be used as carrier for heat. The heated air supplied may optionally be heated by heat from a heat source 54. In case of overheated vapor said speed-up of the drying process occurs in a high degree if "superheated" water vapor, having a temperature of 110° to 150° C., is introduced from container 80 into cleaning chamber 10 immediately after the completion of the vacuum shock, while the shock is yet hot and the pump 34 is running.

In connection with the aforementioned hard-to-dry stock, such a heat application by means of superheated steam has proven to be particularly effective under the following conditions: With the vacuum pump 34 running, 220 to 400 liters of steam having an average temperature of 120° C. are introduced into cleaning chamber 10 over an arbitrary period of time of approximately 30 to 180 seconds. Since many parameters are of significance for speeding up the drying, it is practical to determine empirically the most effective combination of parameters for each type of stock, in case of introducing heated air in the vacuum chamber 10. Supplying of the heated air may proceed before or after the 'vacuum shock'. In case of supplying after the 'vacuum shock' this should be done in such a quantity and in such a quickness that the present vacuum in the cleaning chamber 10 is not substantially decreased. This aim is attainable by full running vacuum pump 34. The supplied heated air is controlled by the same connection and valve means as the said overheated vapor.

It has been proven in the course of many tests that by means of the vacuum shock in the above sense, in combination with an application of heat to the stock by means of superheated water vapor, it is possible to achieve a speed-up of the drying process, depending on the type of the stock, by 1½ to 10 times.

At the end of the washing phase the washing fluid is transferred from the washing vessel 11 to the collecting vessel 15 for collecting solid dirt particles in the washing fluid in a sieve basket 24 and then from the collecting vessel to the washing fluid reservoir.

If the sieve basket 24 is required to empty said process includes a further drying phase for drying the solid dirt particles in the sieve basket 24, which phase includes placing the valve means in a third state in which the vacuum pump is connected directly with the collecting vessel 15 by line 45 controlled by valve 58 and in which the collecting vessel 15 is sealed from the remainder of the washing fluid circuit and ambient atmosphere and operating the vacuum pump to produce a vacuum in the collecting vessel for drying.

An alternative connection between the vacuum pump 34 and the collecting vessel may be established by lines 51', **51*a* via the washing vessel. In this case the connection is controlled by valve means 72*a*, 56, 14. Sometimes it is required to dry the filter in the filter housing 59**, especially before changing the filter.

In this case the process includes a further drying phase for drying said filter, which phase includes placing the valve means in a fourth state in which the vacuum pump 34 is connected with the filter housing 59 and in which the filter housing is sealed from the remainder of the washing fluid circuit and ambient atmosphere, and operating the pump to produce a vacuum in the collecting vessel.

In dependence on the degree to which the objects to be cleaned are soiled the filter contained in the filter housing 59 must be replaced from time to time. The valves 31, 31', 61, 28, 60, 28' associated with the filter housing 59 are operated as follows.

During the operation in the cleaning mode, the shut-off valve 29 and the valves 28 and 31' are closed so that the cleaning fluid is pumped through the open valve 31 in line **46*a* into the cleaning chamber 10. As the cleaning fluid is drained from the collecting vessel 15, the cleaning fluid will then flow through the pump 27 into the filter housing 59 when the valves 28, 29, 31 are closed and the valve 31' is open. When the aqueous washing fluid has been filtered in the filter housing 59 the manually operable valve 28' is opened so that the washing fluid is then drained into the cleaning fluid reservoir which is not shown. For a replacement of the filter the valves 28', 60, 29, 30 and 31' are closed and the pump 27 is operated so that liquid contained in the filter housing 59 is sucked out of the filter housing through the valve 28 which has been opened. For a supply of air, the valve 61 is opened. The liquid which has thus been pumped off is fed through the line 46*a* into the cleaning chamber 10 when the valve 31 is open and said liquid can then be re-used. After the liquid has been pumped from the filter housing, the valves 28 and 61 are closed too and the valve 60 is subsequently opened to connect the filter housing 59 to pump 34 while the valve 56 is closed. The valve 61** may optionally be connected to a heat exchanger for a supply of heated air to the filter housing so as to effect a more intense drying (in a manner not shown).

The entire system is so designed that it can easily be connected to a different machine. The stock to be cleaned may be supplied in baskets on roller conveyors. Such baskets will then be vertically lifted from the roller conveyor by handling means and are then moved over the cleaning system which is disposed laterally of the roller conveyor. When the cover **11*a*** of the cleaning vessel has been opened, the basket may be lowered into the cleaning chamber.

The cleaning and drying cycle may be completed in a cycle time usually amounting to about four to ten minutes. That cycle time may be reduced further if the system comprises two separate cleaning chambers, which are connected in parallel and operated in the cleaning and drying modes in alternation. It is apparent that the machine is designed in every respect to reduce the amount of waste which will have to be disposed of.

While the description above refers to particular embodiments of the present invention, it will be understood that many modifications may be made without departing from the spirit thereof. The accompanying claims are not intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

In the above description the cleaning chamber 10 is also used as a drying chamber. It may be understand that in some cases it may be also of advantage to provide a separate drying chamber. In this case after the washing phase the shock is transferred to the drying chamber. In the claims therefore the term "cleaning chamber" means also a combination of a cleaning chamber and a drying chamber.

What is claimed is:

1. A process for washing and drying stock consisting of discrete metal objects in a system composed of: an aqueous washing fluid circuit including a washing fluid reservoir for holding an aqueous washing fluid constituted by hot water and at least one washing vessel connected to receive the washing fluid from the reservoir; a stock carrier contained in the washing vessel to support the stock; an underpressure container; a vacuum pump; and connection means including conduits and valve means connected for controlling communication among the pump, the underpressure container and the washing vessel, said process comprising:

a washing phase for washing the stock including:

supporting stock in the stock carrier in the washing vessel;

operating the washing fluid circuit to bring washing fluid into contact with stock in the washing vessel and maintaining the washing fluid in contact with the stock for a sufficient time to heat the stock and to effect cleaning of the stock; and a phase including: connecting the underpressure container to the pump whereby the washing vessel is isolated from the pump and from the underpressure container, and operating the pump to place the underpressure container under a vacuum pressure substantially below atmospheric; and a drying phase beginning at a time when the washing fluid is drained from the washing vessel, the temperature of the stock is substantially at the temperature of the washing fluid, the pressure in the washing vessel is substantially atmospheric, and the underpressure container is at the vacuum pressure; and including: abruptly placing the valve means in a first state in which the underpressure container is connected to the washing vessel for producing an abrupt pressure drop, resulting in a vacuum shock in the washing vessel and across the entirety of the surfaces of the stock and to achieve pressure equalization between the washing vessel and the underpressure container; after said step of placing the valve means in a first state placing the valve means in a second state to connect the vacuum pump with the washing vessel and to isolate the vacuum container from the washing vessel and operating the pump until the end of the drying phase to increase continuously the underpressure in the washing vessel, produced by the pressure equalization between the washing vessel and the underpressure container, approximately up to the maximum underpressure attainable by the vacuum pump.

2. A process as defined in claim 1 wherein the system further includes an overpressure container provided with means for generating superheated steam, and second connection means including a line having an adjustable cross section for selectively connecting the overpressure chamber to the washing vessel, and said method further comprises, during said drying phase:

immediately following completion of said step of abruptly placing the valve means in a first state, operating the second connection means for effecting a gradual pressure equalization between the overpressure container and the washing vessel and for causing superheated steam to flow into the washing vessel in order to transfer heat energy from the steam to the shock.

3. A process as defined in claim 2 wherein the step of operating the second connection means is carried out so that the pressure equalization and the flow of steam take place for between 10 and 500 seconds.

4. A process as defined in claim 2 wherein said step of operating the second connection means is carried out after said step of abruptly placing the valve means in a second state, at a time such that at the start of equalization and steam flow the vacuum pressure in the washing vessel is at least 60% of the maximum vacuum pressure created in the washing vessel.

5. A process as defined in claim 1 wherein the system further includes an overpressure container provided with means for generating superheated steam, and second connection means for selectively connecting the overpressure container to the washing vessel, and said process further comprises a degreasing phase for stock soiled with sludge, comprising:

operating the second connection means for delivering superheated steam from the overpressure container to the washing vessel so that the steam condenses on the stock and removes sludge therefrom;

then conducting the condensed steam from the washing vessel to the underpressure container to permit the sludge to be removed from the condensed steam.

6. A process as defined in claim 5 wherein said degreasing phase further comprises removing sludge from the condensed steam in the underpressure container.

7. A process as defined in claim 1 wherein the system further includes an overpressure container provided with means for generating superheated steam, and second connection means for selectively connecting the overpressure container to the washing vessel, wherein said washing phase further comprises, after said step of operating the washing fluid circuit: introducing the superheated steam into the washing vessel and allowing the steam to condense on the stock so that the stock is rinsed by the condensed steam; and then transferring the condensed steam to the overpressure container for conversion back into superheated steam.

8. A process as defined in claim 1 wherein the washing fluid circuit further includes a collecting vessel disposed below the washing vessel for receiving washing fluid from the washing vessel and constructed to hold vacuum; said process further comprising:

at the end of said washing phase, transferring washing fluid from the washing vessel to the collecting vessel for collecting solid dirt particles in a sieve basket insert of the collecting vessel and then from the collecting vessel to the washing fluid reservoir; said process further comprising: a drying phase for drying said solid dirt particles in said sieve basket, if the sieve basket insert is required to be empty, including:

placing said valve means in a third state in which the said vacuum pump is connected with the collecting vessel directly or via cleaning vessel and in which the collecting vessel is scaled from the remainder of the washing fluid circuit and ambient atmosphere; and operating the pump to produce a vacuum in the collecting vessel.

9. A process as defined in claim 1 wherein the washing fluid circuit further includes a filter housing containing a filter and constructed to hold a vacuum and disposed in the circuit so that washing fluid can flow from the washing vessel to the washing fluid reservoir while passing through the filter, said filter housing being connected to the connection means, said process further comprising:

transferring washing fluid from the washing vessel to the washing fluid reservoir; and a drying phase for drying said filter in said filter housing, including placing said valve means in a fourth state in which the said vacuum pump is connected with the filter housing directly and in which the filter housing is scaled from the remainder of the washing fluid circuit and ambient atmosphere, and operating the pump to produce a vacuum in the collecting vessel.

10. A process as defined in claim 1 wherein the system further includes a heat source in a chamber for generating heated air and the second connection means including a line having an adjustable cross section for selectively connecting the generating chamber to the washing vessel and said method further comprises during said drying phase:

causing heated air to flow into the washing vessel.

* * * * *